US007880631B1

(12) United States Patent
Herz

(10) Patent No.: US 7,880,631 B1
(45) Date of Patent: Feb. 1, 2011

(54) COORDINATE-BASED SYSTEM, METHOD AND COMPUTER PROGRAM PRODUCT FOR DISABLING A DEVICE

(75) Inventor: William S. Herz, Hayward, CA (US)

(73) Assignee: NVIDIA Corporation, Santa Clara, CA (US)

( * ) Notice: Subject to any disclaimer, the term of this patent is extended or adjusted under 35 U.S.C. 154(b) by 466 days.

(21) Appl. No.: 11/766,935

(22) Filed: Jun. 22, 2007

(51) Int. Cl.
*G08B 21/00* (2006.01)

(52) U.S. Cl. ..... 340/652; 340/654; 340/635

(58) Field of Classification Search ..... 340/539.1, 340/539.11, 531, 500, 539.13, 635, 652, 340/654, 657; 455/404.2, 408, 410, 411
See application file for complete search history.

(56) References Cited

U.S. PATENT DOCUMENTS 5,530,431 A * 6/1996 Wingard ..... 340/310.11
6,678,612 B1 * 1/2004 Khawam ..... 701/213
7,450,024 B2 * 11/2008 Wildman et al. ..... 340/669
2003/0060212 A1 * 3/2003 Thomas ..... 455/456
2004/0043774 A1 * 3/2004 Lee ..... 455/456.1
2005/0035862 A1 * 2/2005 Wildman et al. ..... 340/573.1
2005/0068169 A1 * 3/2005 Copley et al. ..... 340/539.13
2005/0242971 A1 * 11/2005 Dryer ..... 340/870.11
2007/0247316 A1 * 10/2007 Wildman et al. ..... 340/572.4

OTHER PUBLICATIONS

U.S. Appl. No. 11/685,093, filed Mar. 12, 2007.
U.S. Appl. No. 11/532,809, filed Sep. 18, 2006.

* cited by examiner

*Primary Examiner*—Van T. Trieu
(74) *Attorney, Agent, or Firm*—Zilka-Kotab, PC

(57) ABSTRACT

A coordinate-based system, method, and computer program product are provided for disabling a device. In use, a power down state of a device is detected. In response to the power down state, a first set of coordinates of the device is stored. Additionally, a power up state of the device is detected. In response to the power up state, a second set of coordinates of the device is identified. Further, the first set of coordinates and the second set of coordinates are compared. To this end, the device may be conditionally disabled based on the comparison.

21 Claims, 6 Drawing Sheets

COORDINATE-BASED SYSTEM, METHOD AND COMPUTER PROGRAM PRODUCT FOR DISABLING A DEVICE

FIELD OF THE INVENTION

The present invention relates to securing electronic devices, and more particularly to preventing electronic device theft.

BACKGROUND

Generally, many electronic devices have been mobile by nature, such that they are usable at various locations, etc. Thus, movement of such devices from one location to another has been desired and thus facilitated. Unfortunately, the mobility of electronic devices has also encouraged unwanted movement, such as in the case of theft. Traditionally, electronic devices have been secured from such unwanted movement by securing the outer premises (e.g. house, car, etc.) in which such devices reside. However, such form of security is often subject to circumvention, etc.

There is thus a need for addressing these and/or other issues associated with the prior art.

SUMMARY

A coordinate-based system, method, and computer program product are provided for disabling a device. In use, a power down state of a device is detected. In response to the power down state, a first set of coordinates of the device is stored. Additionally, a power up state of the device is detected. In response to the power up state, a second set of coordinates of the device is identified. Further, the first set of coordinates and the second set of coordinates are compared. To this end, the device may be conditionally disabled based on the comparison.

DETAILED DESCRIPTION

Figure 1:
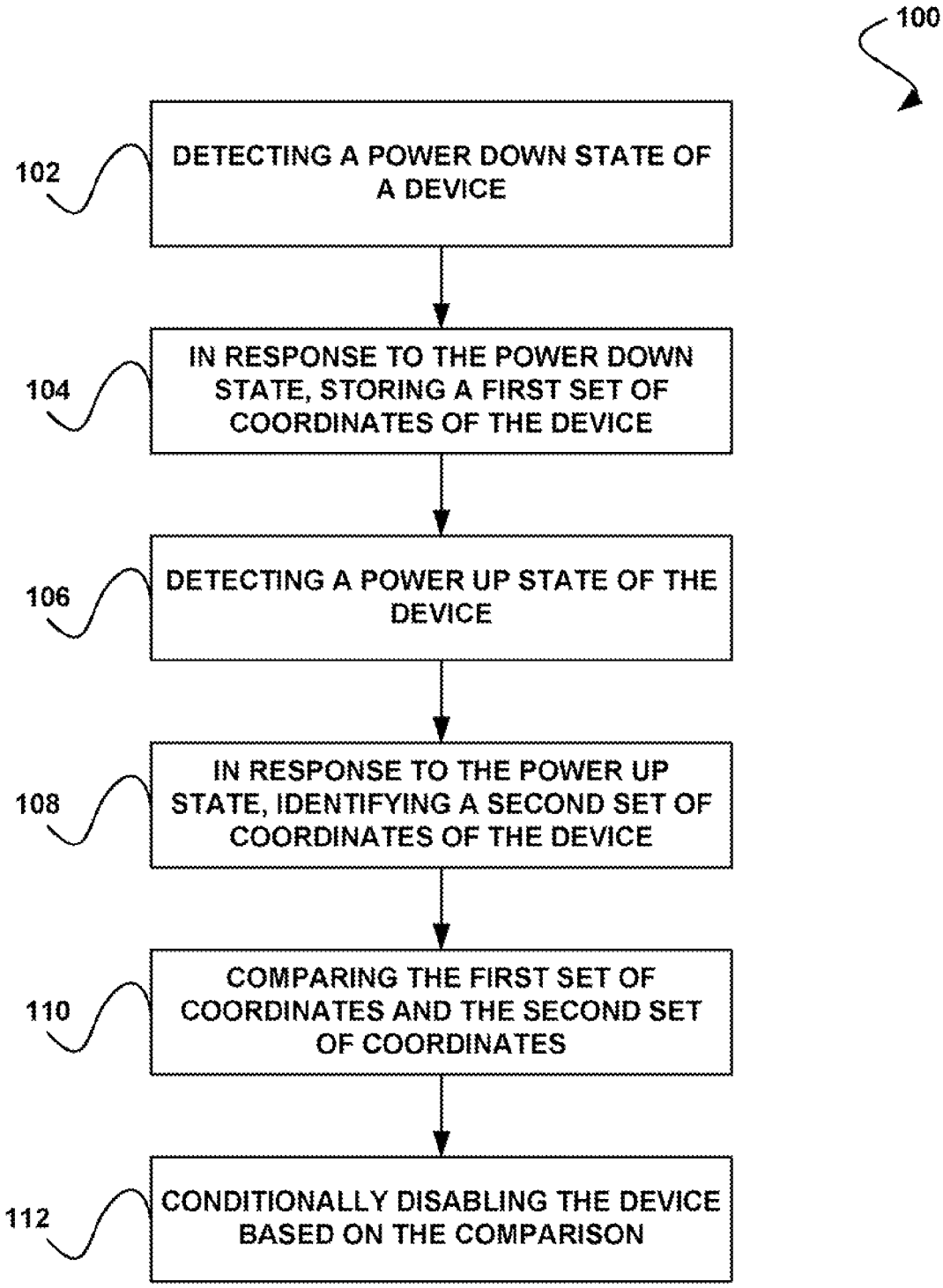
FIG. 1 shows a coordinate-based method for disabling a device, in accordance with one embodiment.

FIG. 1 shows a coordinate-based method 100 for disabling a device, in accordance with one embodiment. As shown in operation 102, a power down state of a device is detected, in the context of the present embodiment, the device may include any device capable of being in a power up state and a power down state.

In one embodiment, the device may include a set-top box. In such embodiment, the set top box may be adapted for receiving, content via a satellite content provider. For example, the set top box may include or be connected to a satellite dish, XM radio device, a digital video recorder (DVR), etc. Thus, the set top box may receive television content, radio content, and/or any other content by way of a satellite.

In another optional embodiment, the set top box may be adapted for receiving content via a cable content provider. For example, the set top box may include or be connected to a cable box, a DVR, etc. In this way, the set top box may receive television content, radio content, and/or any other content by way of a cable medium.

In yet another embodiment, the device ma include a stereo system of a vehicle (e.g. car, boat, etc.). For example, such stereo may be integrated with the vehicle (e.g. powered by the vehicle, etc.). Of course, in another embodiment, the device ma include a home stereo system. In still yet other various embodiments, the device may include a desktop computer, a lap-top/handheld computer, a personal digital assistant (PDA) device, a mobile phone device, a television, and/or any other device, for that matter.

Additionally, the power down state of the device may include any state (e.g. condition, status, etc.) of the device in which the device is deactivated or is in the process of deactivating. For example, deactivating the device may include turning the device off, disabling the device, ceasing a supply of power to the device, etc. In this way, the device may be non-functional after the device is powered down.

In one embodiment, the power down state may be manually initiated. For example, the power down state may be initiated in response to a selection of a power down option by a user. Optionally, the power down option may be associated with the device itself (e.g. a power down switch on the device, etc.), but may also be associated with a power supply of the device (e.g. a power down switch of a vehicle in which the device is integrated, etc.).

In another embodiment, the power down state may be automatically initiated. As an option, such automatic initiation of the power down state may be due to a loss of power that is not necessarily manually initiated. For example, the loss of power may include a cessation in a supply of power to the device (e.g. due to a battery failure, an interruption in electricity flow, etc.). In this way, the power down state may be automatically initiated if a disconnection of the device to an associated power supply occurs.

Further, the power down state of the device may be detected in any desired manner. In one embodiment, the power down state may be detected by the device. In another embodiment, the power down state may be detected by a remote device capable of monitoring a state of the device.

As shown in operation 104, a first set of coordinates of the device is stored in response to the power down state. In the context of the present description, the first set of coordinates of the device may include elevation, latitude, longitude and/or any other type of coordinates capable of identifying a location of the device (e.g. in 2D/3 D) space, etc.). Thus, the first set of coordinates may identify a location of the device at the time of the power down state of the device.

In one possible embodiment, the first set of coordinates may be identified utilizing a global positioning system (GPS). Thus, the device may be in communication with the global positioning system, which may or may not be integrated with the device. Of course, however, the first set of coordinates may be identified in any desired manner (e.g. by way of triangulation, a cell phone, a terrestrial television, Doppler-based techniques, etc.).

In addition, the first set of coordinates may optionally be stored in the device. Of course, however, the first set of coordinates may also be stored within any other device that is in communication (e.g. directly or indirectly) with the system utilized for identifying the coordinates. Further, in one possible embodiment, the first set of coordinates may optionally be stored in flash memory [i.e. rewriteable read-only memory (ROM), etc.]. For example, the first set of coordinates may be stored in random access memory (RAM) during manual initiation of the power down state of the device.

As another option, the first set of coordinates may be encrypted prior to being stored to prevent a third party from gaining access to such coordinates for the purpose of using the same to circumvent the present method 100. Such foregoing encryption may include any algorithm, mechanism, etc. whereby the first set of coordinates is incapable of being accessed, at least in part, by an unauthorized party. To accomplish this, access to the first set of coordinates may only be provided by the decryption thereof. In various embodiments, the first set of coordinates may be encrypted by the system that identifies such coordinates, or by a separate encryption module.

Moreover, a power up state of the device is detected, as shown in operation 106. In the context of the present embodiment, the power up state may include any state of the device in which the device is activated or in the process of activating. For example, activating the device may include turning, the device on enabling the device, providing a supply of power to the device, etc. In one exemplary embodiment, the power up state of the device may include a boot sequence of the device. In this way, the device may be functional after the device is powered up. In addition, the power up state may be subsequent to the power down state of the device identified in operation 102. Thus, the detected power up state may be the next power up state after the detected power down state of the device.

In one embodiment, the power up state may be manually initiated. For example, the power up state may be initiated in response to a selection of a power up option by a user. Optionally, the power up option may be associated with the device itself (e.g. a power up switch on the device, etc.), but may also be associated with a power supply of the device (e.g. a power up switch of a vehicle in which the device is integrated, etc.).

In another embodiment, the power up state may be automatically initiated. As an option, such automatic initiation of the power up state may be based on a provision of power to the device that is not necessarily manually initiated. For example, the provision of power may include an allocation of a supply of power to the device. In this way, the power up state may be automatically initiated if a connection of the device to an associated power supply occurs. Further, the power up state of the device may be detected in any desired manner, including, for example, in the same manner in which the power down state of the device is detected, as described above.

Still yet, as shown in operation 108, a second set of coordinates of the device is identified in response to the power up state. In the context of the present description, the second set of coordinates of the device may also include any type of coordinates capable of identifying a location of the device, similar to the aforementioned first set of coordinates. Accordingly, the second set of coordinates may identify a location of the device at the time of the power up state of the device.

Optionally, the second set of coordinates may be identified in the same manner as the first set of coordinates is identified (e.g. utilizing a GPS, etc.). Of course, however, the second set of coordinates may also be identified in any desired manner. As another option, the second set of coordinates may be encrypted.

Furthermore, the first set of coordinates and the second set of coordinates are compared, as shown in operation 110. Such comparison may be performed in any manner capable of determining whether the first set of coordinates match the second set of coordinates. In one embodiment, the comparison may include comparing the encrypted first set of coordinates and the encrypted second set of coordinates. In another embodiment, the first set of coordinates, and if necessary, the second set of coordinates, may be decrypted for comparing non-encrypted versions thereof.

Also, the comparison may optionally be performed utilizing the device. To this end, the second set of coordinates may be communicated to the device for comparison of such coordinates to the first set of coordinates stored in the device, in one embodiment. In other embodiments, the comparison may be performed by any other devices capable of comparing such coordinates.

To this end, the device may be conditionally disabled based on the comparison, as shown in operation 112. In the context of the present embodiment, disabling the device may include deactivating at least one functional aspect of the device. Thus, in one embodiment, disabling the device may include preventing all aspects of the device from operating, for example.

In one embodiment, disabling the device may include disabling predetermined functionality of the device. Just by way of example, with respect to a stereo system, signal reception may be prevented, audio playback may be prevented, etc. In another embodiment, disabling the device may include preventing full activation of the device. To this end, functionality of the device may be prevented from being turned on, etc.

In use, the device may be disabled if the first set of coordinates and the second set of coordinates do not match in this way, the device may be disabled if a location of the device has changed from the time of the detection of the power down state to the time of the detection of the subsequent power up state. For example, such change in the location of the device may indicate that movement of the device is unwanted (e.g. the device has been stolen, etc.). Accordingly, the device may be prevented from being used when the device has changed locations during, an off state of the device. In one embodiment, the device may remain disabled after a first instance of a lack of a match in coordinates, to prevent any attempt to circumvent the method 100 with subsequent switching between power up and power down states. As will be set forth hereinafter in greater detail during the description of subsequent embodiments, such disabling may be undone only with the use of a key or the like.

Further, the device may be activated if the first set of coordinates and the second set of coordinates match. In various embodiments, such match may or may not be an exact match. For example, in the case of a boat, there may be some threshold of error allowed when confirming the match. When the match is confirmed, the device may be activated from the power up state of the device. Thus, all available functionality of the device may be allowed to operate.

More illustrative information will now be set forth regarding various optional architectures and uses of different embodiments in which the foregoing method 100 may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
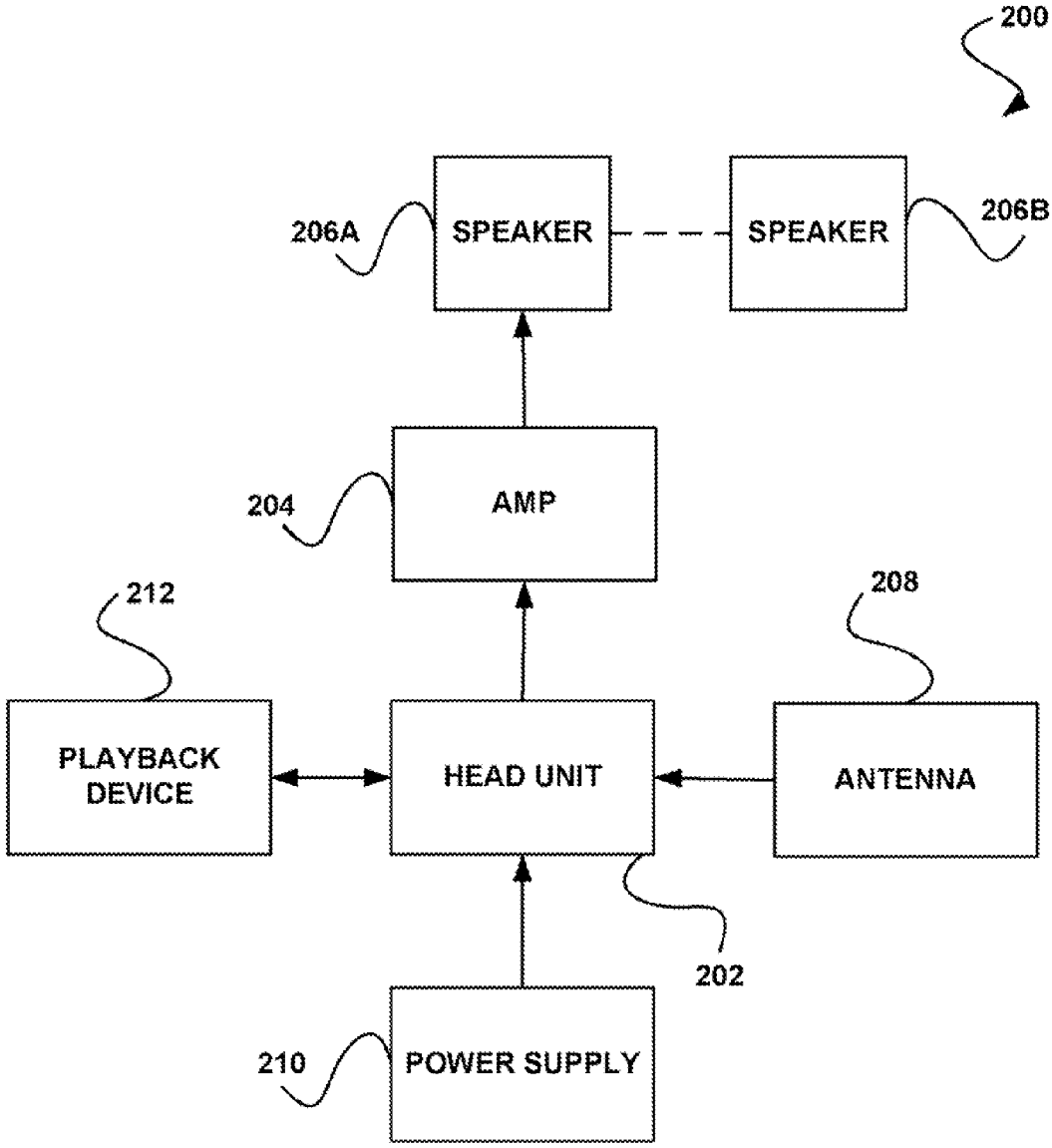
FIG. 2 shows a coordinate-based system for disabling a device, in accordance with another embodiment.

FIG. 2 shows a coordinate-based, system 200 for disabling a device, in accordance with another embodiment. As an option, the system 200 may be implemented to carry out the method 100 of FIG. 1. Of course, however, the system 200 may be used in any desired environment. Further, the aforementioned definitions may equally apply to the description below.

As shown, a head unit 202 is in communication with a playback device 212. In the context of the present embodiment, the playback device 212 may include any device capable of presenting content (e.g. audio, video, images, etc.). For example, the playback device 212 may include a stereo system, television, computer, etc. As also shown, the head unit 202 may be in communication with an antenna 208 to facilitate the receipt of the content (e.g. in the context of a radio, etc.). In addition, the head unit 202 may serve to interface with the playback device 212 for communicating content from the playback device 212 to an amplifier 204 and associated speakers 206A-B for output purposes.

As shown, the head unit 202 may also be coupled to a power supply 210. The power supply 210 may include a battery, an electrical outlet and/or any other source capable of supplying power. In addition, the power supply 210 may provide power to the head unit 202 and/or any other device in communication (either directly or indirectly) therewith. To this end, the power supply 210 may provide power to the playback device 212, the amplifier 204, etc.

In one embodiment, the head unit 202 may be in communication with the playback device 212 via a bus (not shown). Such bus may optionally utilize a protocol for communicating content and control messages. For example, the bus may be utilized by the playback device 212 for communicating content to the head unit 202, whereas the bus may also be utilized by the head unit 202 for communicating control messages to the playback device 212. Optionally, in various embodiments, the bus may include a digital bus, a controller area network (CAN) bus, a media oriented system transport (MOST) bus, a fiber optic bus, etc.

As another option, the head unit 202 may be integrated, packaged, etc. with the playback device 212, and/or any other component, for that matter. Thus, the functionality of the head unit 202 may be included in the playback device 212, in one embodiment. Of course, as shown, the head unit 202 may also be separate from the playback device 212.

In use, the head unit 202 identifies a power down state of the playback device 212. For example, the head unit 202 may monitor the state of the playback device 212 for detecting the power down state. As another example, the playback device 212 may communicate information identifying the power down state to the head unit 202 when the playback device 212 is in the power down state. Even still, the power supply 210 or a connection to it may be monitored for such purpose.

The head unit 202 identifies a first set of coordinates of the playback device 212 in response to the power down state. Such first set of coordinates may therefore indicate the location of the playback device 212 when the power down state is initiated. In one embodiment, the head unit 202 may include a GPS module (not shown) for identifying the first set of coordinates. In such embodiment, the GPS module may not necessarily be accessible by a user for interaction therewith (e.g. via a display, etc.). In another embodiment, the head unit 202 may be separate from the GPS module. To this end, the head unit 202 may optionally be in communication with an independently functioning GPS module that is used for other purposes such as navigation (and thus allows for interaction with a user, etc.).

Once the first set of coordinates of the playback device 212 is identified, such coordinates are stored. In one embodiment, the coordinates may be stored in the head unit 202. For example, the head unit 202 may include writable memory (e.g. flash memory, etc.) for storing the first set of coordinates of the playback device 212.

In addition, the head unit 202 identifies a power up state of the playback device 212. Similar to identifying the power down state, as described above, the head unit 202 may identify such power up state by monitoring the state of the playback device 212, receiving communication from the playback device 212 of such state, monitoring the power supply 210, etc. In this way, the head unit 202 may be capable of identifying at least a power up state and a power down state of the playback device 212.

Further, a second set of coordinates of the playback device 212 is identified by the head unit 202 in response to the power up state of the playback device 212. Such second set of coordinates may therefore indicate the location of the playback device 212 during the power up state. As an option, the head unit 202 may utilize the GPS module described above for such purpose.

Moreover, the first set of coordinates and the second set of coordinates are compared, utilizing the head unit 202. To this end, the head unit 202 may include any logic, circuitry, processor, etc. for performing such comparison. For example, the head unit 202 may read the first set of coordinates stored in the aforementioned memory and compare such coordinates to the second set of coordinates.

Still yet, the head unit 202 may conditionally disable the playback device 212 based on the comparison of the first set of coordinates and the second set of coordinates. In one embodiment, the head unit 202 may disable the playback device 212, if the head unit 202 determines that the first set of coordinates and the second set of coordinates do not match. In this way, the head unit 202 may disable the playback device 212 if it is determined that such playback device 212 moved locations between the time the power down state of the playback device 212 was identified and the time the subsequent power up state of the playback deuce 212 was identified.

For example, the head unit 202 may disable the playback device 212 by communicating a control signal to the playback device 212. Such control signal may be capable of controlling the functionality of the playback device 212, such that the head unit 202 may prevent operation of any of the functionality of the playback device 212 via the control signal. Of course, it should be noted that the head unit 202 may conditionally disable the playback device 212 in any desired manner. On the other hand, the head unit 202 may allow the playback device 212 to be activated if the head unit 202 determines that the first set of coordinates and the second set of coordinates match. Accordingly, operation of the playback device 212 may be controlled based on the coordinates thereof.

Figure 3:
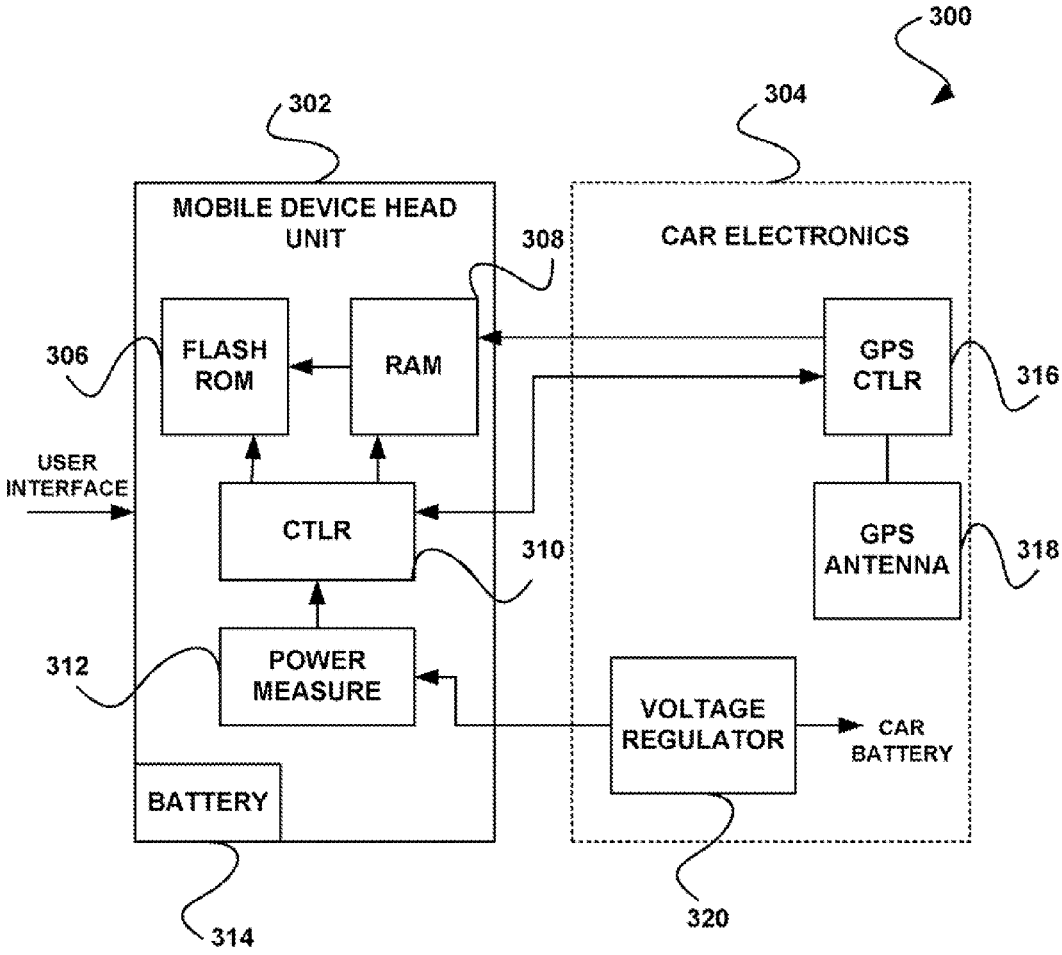
FIG. 3 shows a coordinate-based system for disabling a mobile device utilizing a global positioning system, in accordance with yet another embodiment.

FIG. 3 shows a coordinate-based system 300 for disabling a mobile device utilizing a global positioning system, in accordance with yet another embodiment. As an option, the coordinate-based system 300 may be used to carry out the method 100 of FIG. 1, and/or implement the system 200 of FIG. 2. Of course, however, the coordinate-based system 300 may be used in any desired environment. Further, the aforementioned definitions may equally apply to the description below.

As shown, a mobile device head unit 302 is coupled to car electronics 304. Such mobile device head unit 302 may be coupled to or integrated with a mobile device (e.g. stereo, etc.). In addition, the mobile device head unit 302 may be powered utilizing a battery 314 separate from the car battery, such that the mobile device head unit 302 may be operable regardless of the operability of the car electronics 304.

In the context of the present embodiment, the car electronics 304 are included within a car, but it should be noted that such electronics may be included in any desired vehicle (e.g. boat, etc.), in accordance with other embodiments. As shown, the car electronics 304 include a voltage regulator 320, which is coupled to a car battery. Thus, in one embodiment, the car battery may be utilized for providing power to the car electronics 304, and also the mobile device, as an option.

In addition, such car electronics 304 include a GPS controller 316 communicably coupled to a GPS antenna 318. The GPS controller 316 may include any GPS capable of using the GPS antenna 318 to identify coordinates. In use, the GPS controller 316 may use the GPS antenna 318 to identify coordinates during a power down state and a power up state of the mobile device. As an option, such power down state and a power up state of the mobile device may be indicated to the GPS controller 316 by a controller 310 of the mobile device head unit 302.

To accomplish this, the controller 310 of the mobile device head unit 302 may be capable of monitoring states of the mobile device. In the embodiment shown, the voltage regulator 320 may remain in communication with a power measuring module 312 of the mobile device head unit 302. In this way, the power measuring module 312 may indicate to the controller 310 the power being supplied to the mobile device by the car battery. To this end, the controller 310 of the mobile device head unit 302 may monitor power up and power down states of the mobile device via the power measuring module 312.

Since the GPS controller 316 and GPS antenna 318 are located in the car electronics 304 which is coupled to the mobile device head unit 302, the coordinates identified by the GPS antenna 318 may indicate the coordinates of the mobile device head unit 302. In addition, since the mobile device head unit 302 is coupled to or integrated in the mobile device, identifying the coordinates of the mobile device head unit 302 utilizing the GPS antenna 318 may further indicate the coordinates of the mobile device. In this way, the coordinates of the mobile device may be identified utilizing the GPS controller 316 and GPS antenna 318.

As also shown, the (PS controller 316 is in communication with RAM 308 of the mobile device head unit 302, such that the (PS controller 316 may communicate the identified coordinates to the RAM 308 for storage therein. As another option, such coordinates may optionally be stored in flash ROM 306 of the mobile device head unit 202. By this design, coordinates identified in response to a power down state of the mobile device and a subsequent power up state of the mobile device may be stored. In addition, each set of coordinates for a power down state and a subsequent power up state may be overwritten by a next set of coordinates associated with a sequential power down state and power up state of the mobile device. To this end, only coordinates for a latest power down state and power up state are stored.

With continuing reference to FIG. 3, the controller 310 of the mobile device head unit 302 is in communication with the RAM 308 and ROM 306 for accessing coordinates stored therein. The controller 310 may read coordinates (e.g. coordinates associated with a power down state of the mobile device and coordinates associated with a power up state of the mobile device) for comparing such coordinates. If the controller 310 determines that the coordinates do not match, the mobile device may be disabled. If, however, the controller 310 determines that the coordinates do match, functionality of the mobile device may be allowed.

The mobile device head unit 302 may also be coupled to a user interface (e.g. a user interface of the mobile device, etc.), as shown. The user interface may be utilized for manually enabling the mobile device after the mobile device has been disabled by the controller 310. One example of utilizing such user interface will be described in more detail below with respect to FIG. 4A.

Figure 4A:
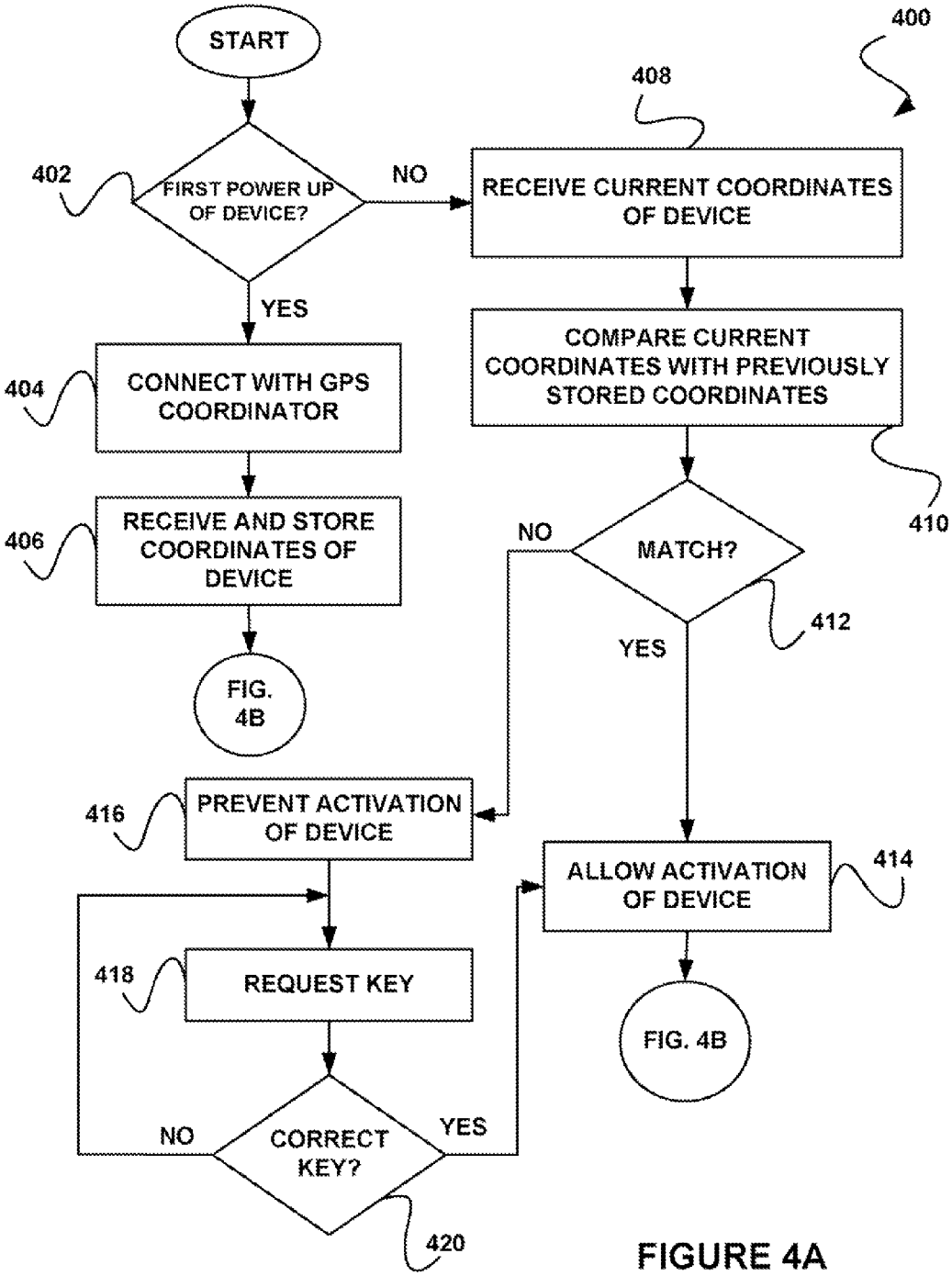
FIG. 4A shows a method for conditionally disabling a device based on coordinates of the device, in accordance with another embodiment.

FIG. 4A shows a method 400 for conditionally disabling a device based on coordinates of the device, in accordance with another embodiment. As an option, the method 400 may be carried out in the context of the details of FIGS. 1-3. Of course, however, the method 400 may be carried out in any desired environment. Further, the aforementioned definitions may equally apply to the description below.

As shown in decision 402, it is determined whether a power up state of a device is a first power up state for the device. For example, the first power up state may indicate that the device has never been previously powered up. If it is determined that the power up state of the device is the first, the device is connected with a GPS, as shown in operation 404. Optionally, the device may be automatically connected with the GPS. In one embodiment, the device may be connected with the GPS by registering the device with the GPS. For example, the device may communicate registration information (e.g. identification information, etc.) to the GPS. Of course, other embodiments employing a unidirectional communication mechanism are contemplated that do not necessarily include the forgoing feature.

In addition, the device receives coordinates associated with a location thereof from the GPS and stores such coordinates. Note operation 406. In this way, the device may store appropriate coordinates in response to a first power up state of such device. While not shown, activation of the device may be unconditionally allowed after operation 406.

If, however, it is determined, that the power up state of the device is not the first (and thus it is assumed that previous coordinates are already stored), current coordinates of the device are received, as shown in operation 408. In the context of the present embodiment, the current coordinates may include coordinates identifying a location of the device during the power up state of the device. In one embodiment, the current coordinates may be received from the GPS.

Further, the current coordinates are compared with previously stored coordinates, as shown in operation 410. With respect to the present embodiment, such previously stored coordinates may include coordinates of the location of the device identified during a previous power down state of the device. For example, such power down state may be a power down state that occurred prior to the power up state.

In some embodiments, previously stored coordinates may not exist. For example, previously stored coordinates may not exist if the device was not connected to a GPS during the last power down state of the device, in such embodiments, the currently stored coordinates may be compared with a null value (which will not trigger a match).

Moreover, it is determined whether the current coordinates match the previously stored coordinates, as shown in decision 412. If it is determined that the current coordinates match the previously stored coordinates, activation of the device is allowed. Note operation 414. Thus, operation of the device may be allowed if the coordinates of the device identified during a last power down state match the coordinates of the device identified during the subsequent power up state.

If, however, it is determined that the current coordinates do not match the previously stored coordinates, the device is disabled, as shown in operation 416. For example, operation of at least some functionality of the device may be prevented from being activated. In this way, operation of the device may be secured when coordinates of the device identified during a last power down state do not match the coordinates of the device identified during the subsequent power up state.

As further shown in operation 418, a key is requested in response to the disablement of the device. In one embodiment, the key may include a predetermined code (e.g. 10 digit code, etc.) associated with the device. For example, the code may optionally be uniquely assigned to the device during manufacture.

Additionally, the key may be requested via a user interface. Just by way of example, such user interface may be integrated with the device. Of course, however, the user interface may also be separate from, but in communication with (directly or indirectly) the device. Thus, the user interface may allow a user to manually input the key.

In response to the prompt for the key, it is determined whether the correct key associated with the device has been inputted, as shown in decision 420 if it is determined that the correct key has been inputted, activation of the device is allowed (see, again, operation 414). To this end, in response to disabling the device, the device may be enabled based on the inputted code.

If however, it is determined that the correct key has not been entered, the key is again requested (see operation 418). As an option, the key may only be requested a predetermined threshold number of times. In this way, once the number of key requests exceeds the threshold, the key may no longer be utilized for enabling the device.

In another exemplary embodiment (not shown), the key may also be utilized by a user for manually locking a current set of coordinates. For example, voluntarily entry of the key (i.e. when not being prompted as in operation 418) may trigger the GPS to identify coordinates of the device. Such coordinates may be stored in the device as authorized coordinates.

In addition, the authorized coordinates may be prevented from being written over during any subsequent power down states of the device, until a subsequent voluntary entry of the key. In this way, the authorized coordinates may be compared with current coordinates during each power up state of the device. This may ensure that the device is disabled if the location of the device is moved from the location indicated by the authorized coordinates and powered up (regardless of a location of the device during a power down state).

In yet another exemplary embodiment, the key may be utilized for resetting the connection between the device and the GPS. For example, if the device loses power spontaneously (e.g. due to battery failure, etc.), connection to the GPS may be reestablished utilizing the key.

Figure 4B:
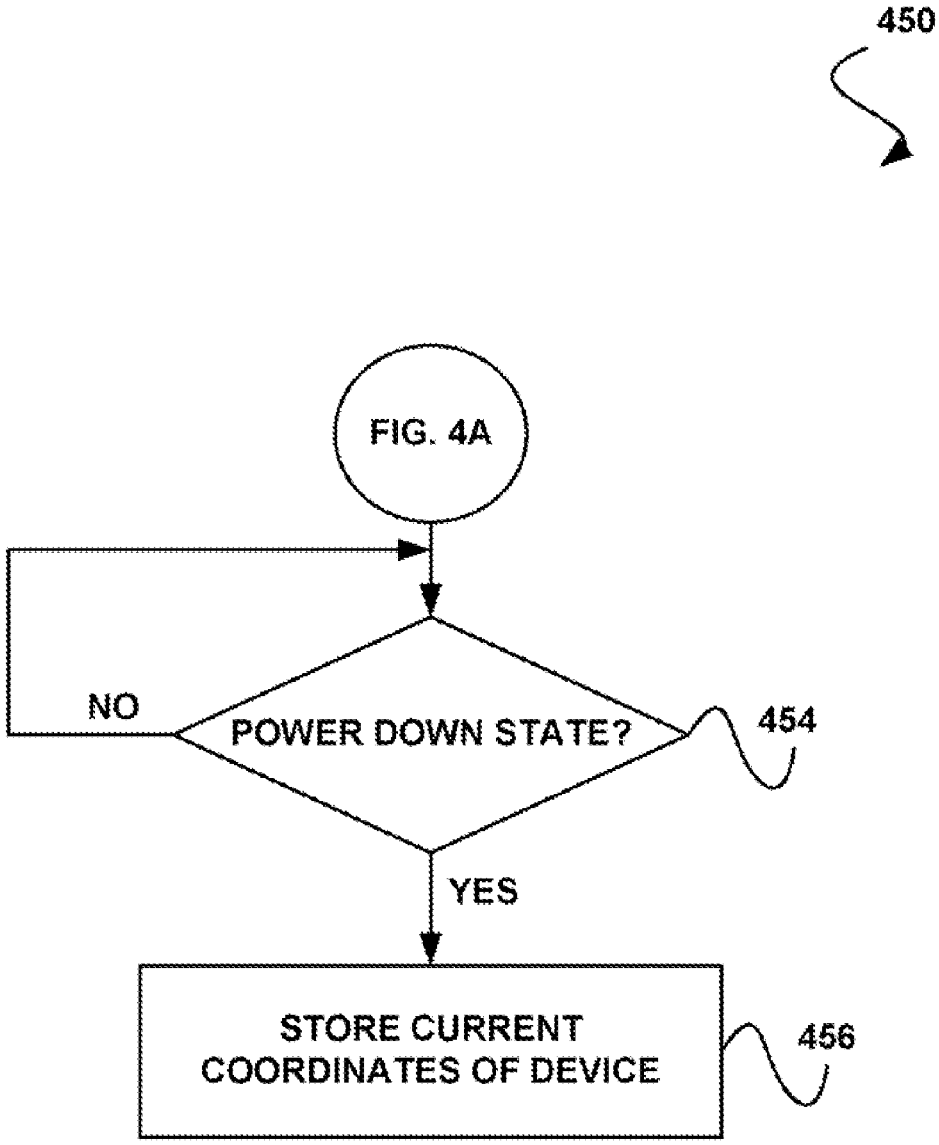
FIG. 4B shows a method for storing current coordinates of a device during a power down state of the device, in accordance with still yet another embodiment.

FIG. 4B shows a method 450 for storing current coordinates of a device during a power down state of the device, in accordance with still yet another embodiment. As an option, the method 450 may be carried out in the context of the details of FIGS. 1-4A. Of course, however, the method 450 may be carried out in any desired environment. Further, the aforementioned definitions may equally apply to the description below.

As shown in decision 454, it is determined whether the device is switched to a power down state. Once it is determined that the device is switched to in a power down state, current coordinates of the device are stored. See operation 456. In this way, coordinates indicating a location of a device during a power down state of such device may be stored.

Figure 5:
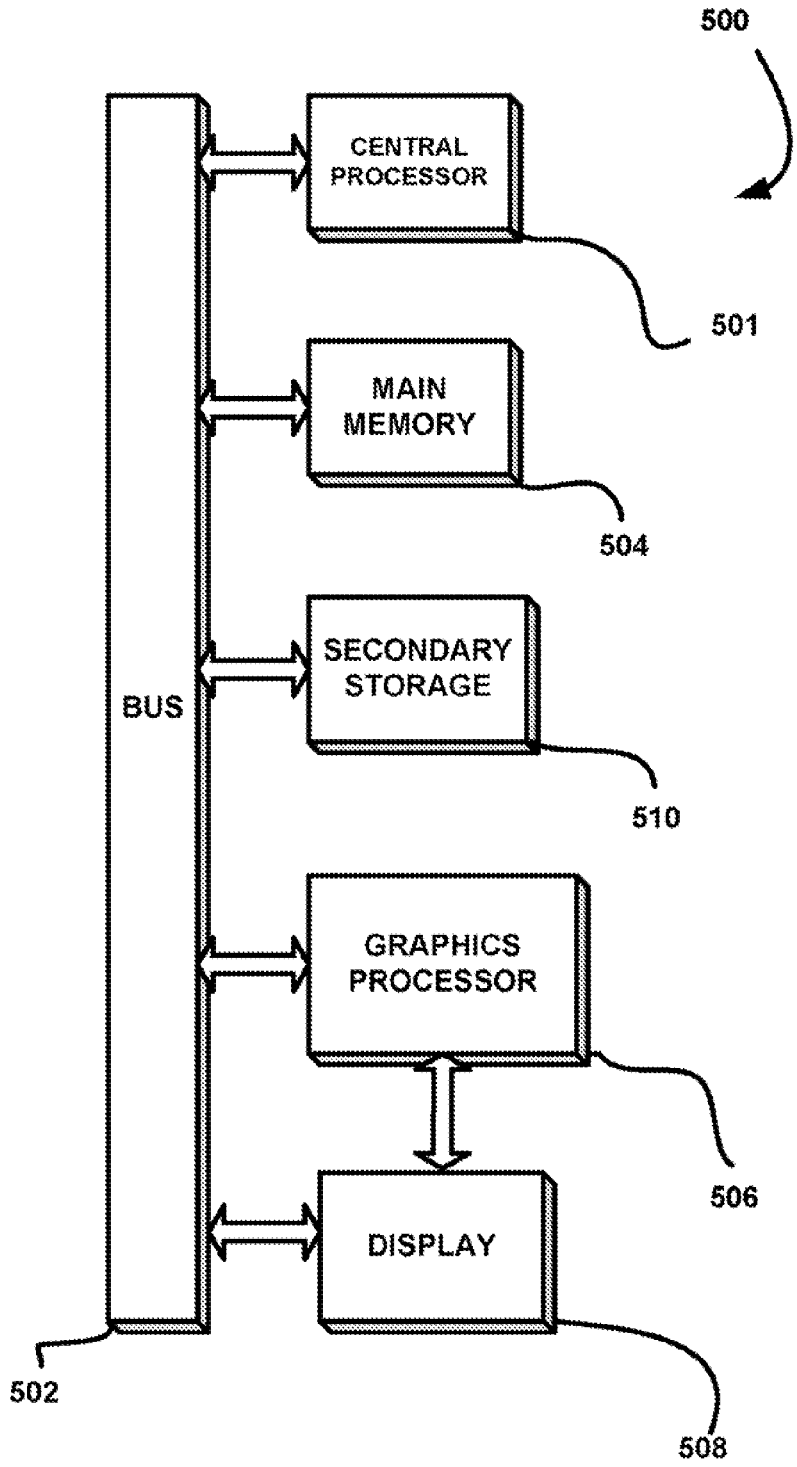
FIG. 5 illustrates an exemplary system with which the various embodiments may be implemented, in accordance with another embodiment.

FIG. 5 illustrates an exemplary system 500, in accordance with another embodiment. As an option, the head unit 202 of FIG. 2 may take the form of the system 500. In other embodiments, the playback device 212 of FIG. 2 or any other device may be modeled after the system 500.

As shown, a system 500 is provided including at least one central processor 501 which is connected to a communication bus 502. The system 500 also includes main memory 504 [e.g. random access memory (RAM), etc.]. The system 500 also includes a graphics processor 506 and a display 508.

The system 500 may also include a secondary storage 510. The secondary storage 510 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 504 and/or the secondary storage 510. Such computer programs, when executed, enable the system 500 to perform various functions. Memory 504, storage 510 and/or any other storage are possible examples of computer-readable media.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

detecting a power down state of a device;

in response to the power down state, storing a first set of coordinates of the device;

detecting a power up state of the device;

in response to the power up state, identifying a second set of coordinates of the device;

comparing the first set of coordinates and the second set of coordinates; and conditionally disabling the device based on the comparison.

2. The method of claim 1, wherein the device includes a stereo system.

3. The method of claim 1, wherein the device includes a set-top box.

4. The method of claim 1, wherein the power down state is manually initiated.

5. The method of claim 1, wherein the power down state is automatically initiated due to a loss of power.

6. The method of claim 1, wherein the first set of coordinates are identified utilizing a global positioning system.

7. The method of claim 6, wherein the global positioning system is integrated with the device.

8. The method of claim 1, wherein the first set of coordinates are stored in the device.

9. The method of claim 1, wherein the first set of coordinates are encrypted.

10. The method of claim 1, wherein the power up state of the device includes a boot sequence of the device.

11. The method of claim 1, wherein the second set of coordinates are identified utilizing a global positioning system.

12. The method of claim 1, wherein the comparison is performed utilizing the device.

13. The method of claim 1, wherein disabling the device includes disabling predetermined functionality of the device.

14. The method of claim 1, wherein disabling the device includes deactivation of the device.

15. The method of claim 1, wherein the device is disabled if the first set of coordinates and the second set of coordinates do not match.

16. The method of claim 1, wherein the device is not disabled if the first set of coordinates and the second set of coordinates match.

17. The method of claim 1, wherein, in response to disabling the device, the device remains disabled and is only allowed to be enabled based on an inputted code.

18. A computer program product embodied on a non-transitory computer readable medium, comprising:

computer code for detecting a power down state of a device;

computer code for storing a first set of coordinates of the device, in response to the power down state;

computer code for detecting a power up state of the device;

computer code for identifying a second set of coordinates of the device, in response to the power up state;

computer code for comparing the first set of coordinates and the second set of coordinates; and computer code for conditionally disabling the device based on the comparison.

19. A system, comprising:

a controller for detecting a power down state of a device, storing a first set of coordinates of the device in response to the power down state, detecting a power up state of the device, and identifying a second set of coordinates of the device in response to the power up state;

wherein the controller is further adapted to compare the first set of coordinates and the second set of coordinates of the device, and to conditionally disable the device based on the comparison.

20. The system of claim 19, wherein the device includes a processor coupled to memory via a bus.

21. A system, comprising:

a controller for detecting a power up state of a device and storing a first set of coordinates of the device in response to the power up state;

wherein the controller is further adapted to compare the first set of coordinates and a second set of coordinates of the device, and to conditionally disable the device based on the comparison;

wherein the system is operable such that the power up state includes a first power up state that indicates that the device has never been previously powered up.

* * * * *